US005212338A

United States Patent [19]

Maher

[11] Patent Number: 5,212,338

[45] Date of Patent: May 18, 1993

[54] AMMUNITION TRANSFER APPARATUS FOR UPLOADING AND DOWNLOADING A MAGAZINE

[75] Inventor: David L. Maher, Burlington, Vt.

[73] Assignee: General Electric Co., Burlington, Vt.

[21] Appl. No.: 726,417

[22] Filed: Jul. 5, 1991

[51] Int. Cl.[5] ..... F41A 9/34

[52] U.S. Cl. ..... 89/45; 89/47; 89/33.04; 89/33.14

[58] Field of Search ..... 89/45, 46, 47, 33.04, 89/33.14, 33.16

[56] References Cited

U.S. PATENT DOCUMENTS

| | | | |
|---|---|---|---|
| 1,138,149 | 5/1915 | Reichard | 89/46 |
| 3,178,005 | 4/1965 | Read | 198/24 |
| 3,501,996 | 3/1970 | Lipp et al. | 89/46 |
| 3,575,275 | 4/1971 | Reimers et al. | 198/24 |
| 3,696,704 | 10/1972 | Backus et al. | 89/34 |
| 4,727,790 | 3/1988 | DeHaven et al. | 89/46 |
| 4,772,171 | 9/1988 | Mayer et al. | 414/125 |

FOREIGN PATENT DOCUMENTS

| | | | |
|---|---|---|---|
| 3733214 | 4/1989 | Fed. Rep. of Germany | 89/45 |

*Primary Examiner*—Stephen M. Johnson
*Attorney, Agent, or Firm*—Stephen A. Young

[57] ABSTRACT

To automate the uploading and downloading of a magazine storing rounds of large caliber ammunition in horizontal orientation, a transfer mechanism is equipped with a set of transfer forks and a set of selector gates operating is synchronism with a magazine rotary conveyor to laterally transfer ammunition rounds between a linear transfer conveyor and carrier positions on the rotary conveyor. The selector gates serve to pick rounds from carrier positions swinging through a turnaround of the rotary conveyor during downloading and to provide underlying, rolling support for the rounds during uploading and downloading transfer movement controlled by the transfer forks. Alternatively, the transfer mechanism is equipped to upload and download a pair of magazines stationed on opposite sides of the linear conveyor.

18 Claims, 8 Drawing Sheets

AMMUNITION TRANSFER APPARATUS FOR UPLOADING AND DOWNLOADING A MAGAZINE

The present invention generally relates to article handling apparatus and particularly to apparatus for transferring large caliber ammunition between a linear conveyor and a rotary magazine conveyor.

BACKGROUND OF THE INVENTION

To logistically support large caliber artillery pieces, such as howitzers, ammunition is uploaded into a resupply vehicle at an ammunition field depot, transported to the artillery battery locations and then downloaded. The tasks of uploading and downloading ammunition to and from the resupply vehicle are highly labor intensive and time consuming. Since artillery projectiles can weigh upwards of one hundred pounds, the labor in manually handling them is arduous indeed. To ease the labor burden and to save time, equipment to mechanize the handling of large caliber ammunition has been proposed. Such equipment includes linear belt conveyers to convey the ammunition to and from the resupply vehicle. The interior of a resupply vehicle is equipped as a large magazine in which the ammunition is stored on an endless rotary conveyor to further automate uploading and storage, and subsequent downloading. A magazine conveyor of this character is disclosed in commonly assigned, copending appreciation entitled "Magazine Conveyor for Large Caliber Ammunition", U.S. patent application Ser. No. 07/633,553, filed Dec. 24, 1990. Unfortunately, the magazine conveyor disclosed therein stores the ammunition in vertical orientation, whereas the linear belt conveyors must convey the ammunition rounds while lying on their sides, i.e., in essentially horizontal orientation. Consequently, a reorienter is required between the linear conveyor and the magazine conveyor to change the orientation of each round from horizontal to vertical during uploading and from vertical to horizontal during downloading. In certain situations, the projectiles must be uploaded base first and downloaded nose first, and therefore the reorienter must also provide the requisite end-for-end reorientation. One such situation occurs when ammunition is down loaded from an automated resupply magazine and uploaded into an automated weapon magazine serving an autoloading howitzer. If the reorienter is automated, it adds complexity and expense and consumes space. If not, it requires manual operation, and thus reductions in resupply personnel are not maximized.

SUMMARY OF THE INVENTION

It is accordingly an objective of the present invention to provide ammunition handling apparatus that eliminates the need for round reorientation during uploading and downloading of ammunition and thus avoids the above-noted drawbacks associated with its use. To this end, an ammunition magazine is provided with automated apparatus for handling ammunition totally in horizontal orientation during uploading, downloading, and while in magazine storage. Thus, the automated magazine includes an endless ammunition conveyor trained throughout the magazine and equipped with retaining elements for securing horizontally oriented ammunition rounds in a succession of carrier positions. The magazine further includes a linear transfer conveyor to present successive ammunition rounds to the magazine conveyor for uploading lateral transfer into carrier positions of the magazine conveyor as they swing through a turnaround section of the conveyor path. During downloading, ammunition rounds are successively laterally transferred from magazine conveyor carrier positions swinging through the turnaround section to the transfer conveyor and conveyed away in a serial stream.

To control this lateral transfer between the transfer and magazine conveyors, the magazine handling apparatus includes sets of ammunition round cradling forks and supporting selector gates which are articulated in synchronism with the magazine conveyor motion through the turnaround section. In an alternative embodiment of the invention, the transfer conveyor, one set of transfer forks and two sets of selector gates are utilized to laterally transfer and thus upload and download ammunition rounds to and from a pair of magazine conveyors positioned in confronting relation at opposite sides of the transfer conveyor.

The invention accordingly comprises the features of construction, combinations of elements and arrangements of parts, all as detailed below, and the scope of the invention will be indicated in the claims.

BRIEF DESCRIPTION OF THE DRAWINGS

For a full understanding of the nature and objects of the present invention, reference may be had to the following Detailed Description taken in conjunction with the accompanying drawings, in which.

Corresponding reference numerals refer to like parts throughout the several views of the drawings.

DETAILED DESCRIPTION

Figure 1:
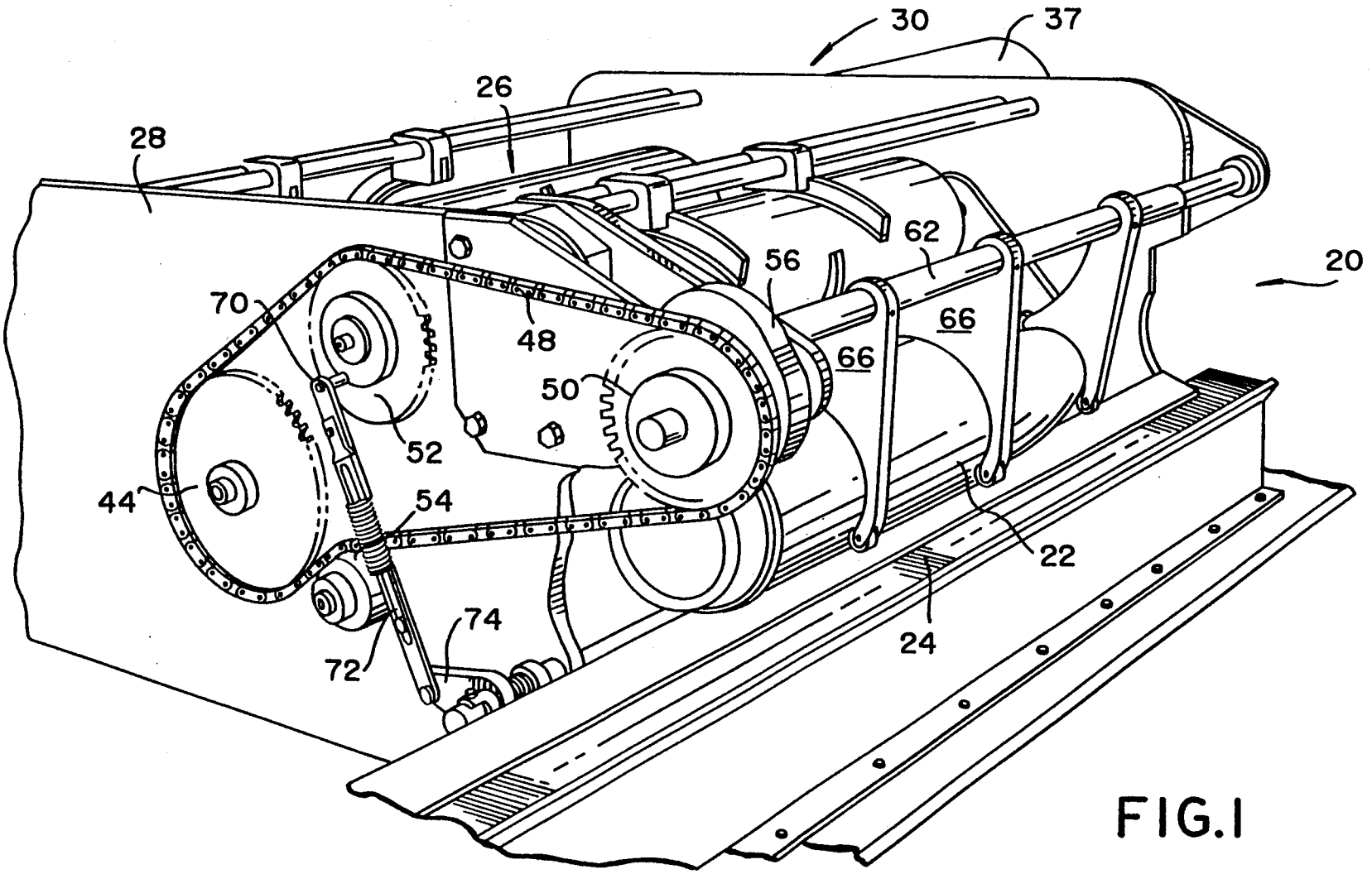
FIG. 1 is a perspective view of an automated ammunition storage magazine utilizing ammunition transfer apparatus constructed in accordance with an embodiment of the present invention.

The transfer apparatus of the present invention, generally indicated at 20, is seen in FIG. 1 in its application to laterally transfer ammunition rounds 22 between a linear transfer conveyor 24 and an endless, rotary magazine conveyor, generally indicated at 26. The transfer conveyor is stationed in a predetermined position relative to a turnaround section of the magazine conveyor path, which is preferably serpentine to maximize storage density, and may be affixed to the framework 28 of the magazine, generally indicated at 30. The magazine conveyor and the transfer apparatus are driven by a motor 37 which may also be employed to drive the transfer conveyor. Ammunition rounds, which consist of either projectiles or propellant canisters, as disclosed in the above cited copending U.S. patent application Ser. No. 633,553, are serially conveyed on their sides in horizontal orientation by the transfer conveyor into an upload position aligned with the transfer apparatus for lateral transfer into carrier positions on the magazine conveyor as they swing through the turnaround section to upload magazine 30. The ammunition rounds remain in horizontal orientations while retained in their carrier positions on the magazine conveyor during circulation throughout and storage within the magazine. When downloading the magazine, the transfer apparatus laterally transfers ammunition rounds from their carrier positions as they swing through the turnaround section to the transfer conveyor which then removes each round to clear the way for the next round. It will be appreciated that the transfer conveyor communicates at either or both ends with linear resupply conveyors (not shown) for conveying rounds to and from magazine 30. Thus, a resupply conveyor would be utilized to upload magazine 30 in a resupply vehicle at a resupply depot and to download the vehicle at the battery site. A resupply conveyor would also be used to link to two magazines 30, one in the resupply vehicle and the other in a self-propelled howitzer (SPH). Thus, the present invention can be utilized to completely automate the rearming of an SPH.

Figure 2:
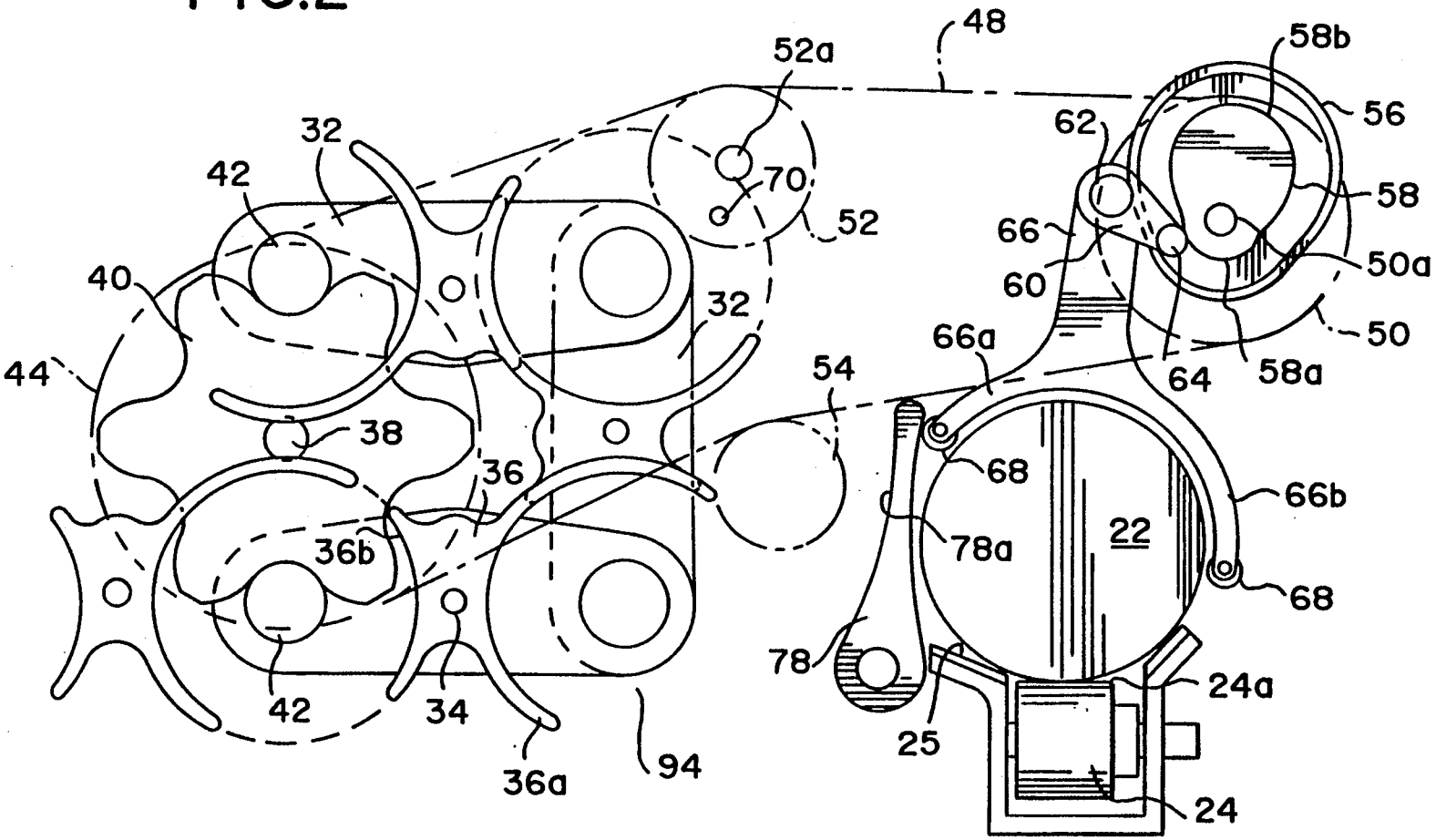
FIGS. 2 through 4 are a series of simplified side views of the transfer apparatus of FIG. 1 to illustrate the operation thereof in laterally transferring an ammunition round between a linear transfer conveyor and a endless magazine conveyor.

Referring jointly to FIGS. 1 and 2, magazine conveyor 26, which may be basically of the construction shown in the cited copending application except turned on its side to handle ammunition rounds in horizontal orientation rather than in vertical orientation, includes a pair of laterally opposed endless chains, each consisting of pivotally interconnect links 32, as seen in FIG. 2. The chains are interconnected at regularly spaced intervals by a series of rungs 34, each also serving to mount several retainers 36 in horizontally spaced relation. Each retainer includes a pair of generally oppositely faced cradle elements **36*a* and 36*b* configured to conform to and wrap partially around the periphery of an ammunition round. Cradle elements 36*a* and 36*b* of adjacent rungs are thus in facing relation, such that they can cradle and hold ammunition rounds in horizontal carrier positions on the magazine conveyor between successive pairs of rungs. Cradle elements 36*a* are larger than cradle elements 36*b* such that the former cradle an ammunition round over an included angle of 180°, while the latter elements cradle a round over an include angle between 60° and 90°. Thus, while the ammunition rounds are in straight run sections of the magazine conveyor serpentine path, the retainer elements cradle the rounds over an included angle well in excess of 180° to securely hold them in their carrier positions. However, in a 180° turnaround section of the magazine conveyor path, such as the one illustrated in FIG. 2, cradle elements 36*a* and 36*b* assume lapping relations, and thus ammunition rounds are cradled solely by the larger cradle elements 36*a*** to permit uploading and downloading of rounds into and out of the carrier positions.

Magazine conveyor 26 is powered in its serpentine path by motor 37 drivingly connected to a shaft 38 which mounts a pair of turnaround sprockets 40. These turnaround sprockets engage laterally projecting drive pins 42, some of which also serve as the pivotal connections between chain links 32. For a more detailed description of the features of magazine conveyor 26 applicable to the present invention, reference may be had to the cited copending U.S. patent application Ser. No. 633,553, the disclosure of which is specifically incorporated herein by references.

Referring jointly to FIGS. 1 and 2, to drive transfer apparatus 20 in synchronism with the magazine conveyor, a drive sprocket 44 is selectively drivingly connected to turnaround sprocket shaft 38 via a clutch 46, which will be described later in conjunction with FIG. 5. This drive sprocket, in turn, drives a chain 48 which is in engagement with a transfer fork drive sprocket 50, a selector gate drive sprocket 52 and an idler sprocket 54. Sprocket 50 is mounted by magazine frame 28 and carries a transfer fork operating cam 56 featuring an annular camtrack 58 having a 120° dwell section **58*a* and a 240° lobe section 58*b*. A crank arm 60 is pinned to an elongated transfer fork shaft 62 mounted at its ends by the magazine frame 28 in a position generally above and parallel with linear transfer conveyor 24. The free end of this crank carries a cam follower 64 which rides in camtrack 58. Also pinned to shaft 62 is a set of spaced transfer forks 66, each having a pair of diverging tines 66*a* and 66*b* which serve to mount rollers 68** at their free ends.

Figure 6:
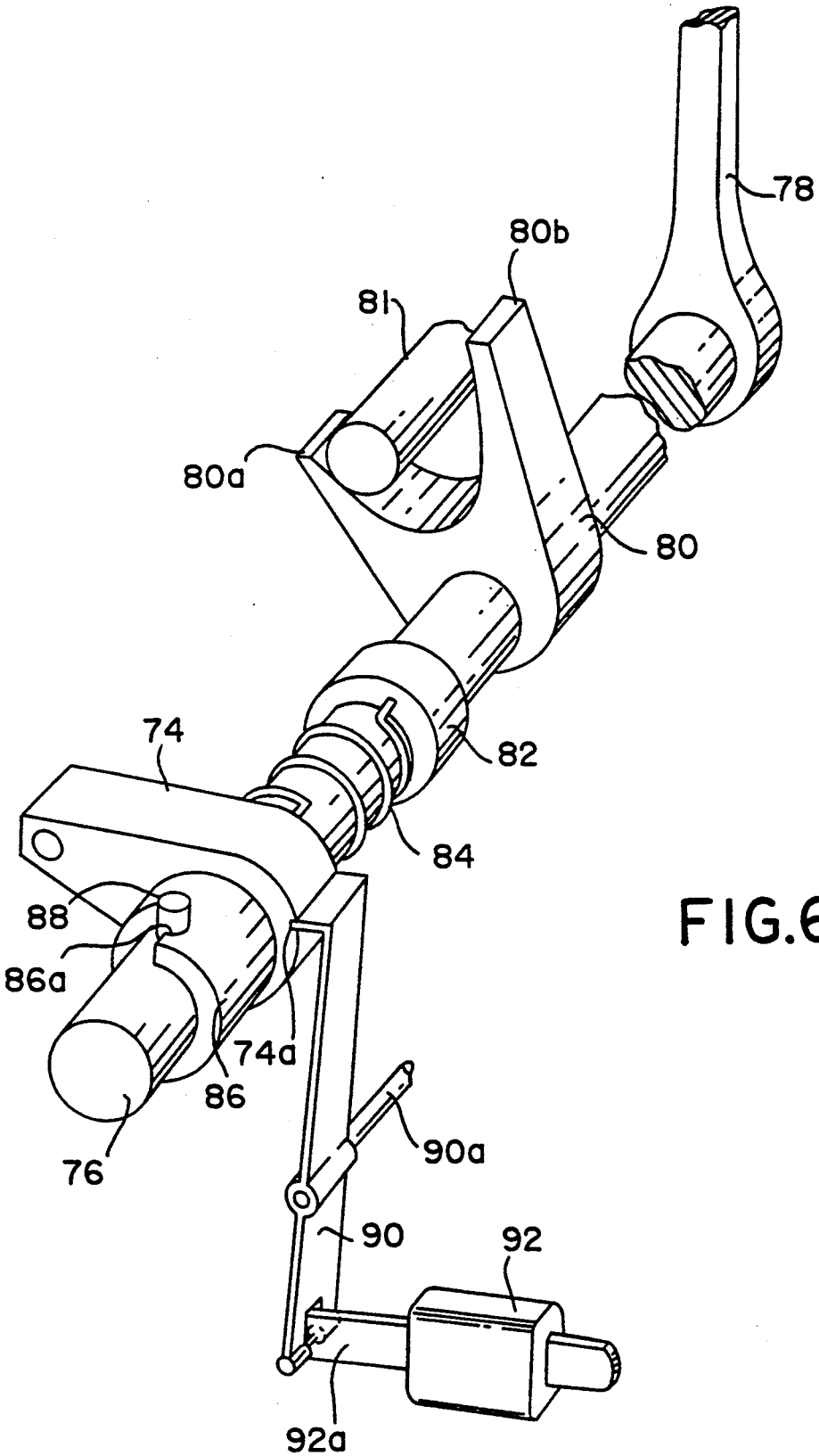
FIG. 6 is a simplified perspective view of a portion of the selector gate drive included in the transfer apparatus of FIG. 1.

Sprocket 52 is journalled on a stub shaft **52*a* mounted by the magazine frame and carries an eccentric drive pin 70 projecting from its outer face as seen in FIG. 1. The upper end of a spring-loaded, lost motion connecting rod 72 is pivotally connected to drive pin 70. The lower end of the connecting rod is pivotally connected to the free end of a crank arm 74 sliding received on an end of an elongated selector gate shaft 76 mounted between the magazine sideplates in a horizontal position parallel to the upper run of linear transfer conveyor 24. Pinned to this shaft is a set of at least two selector gates 78 (one seen in FIGS. 2 and 6) in horizontally staggered relation with transfer forks 66. Turning to FIG. 6, also affixed on shaft 76 are a selector gate stop bracket 80 and a collar 82. The stop bracket is bifurcated to provide a pair of projections 80*a* and 80*b* which straddle a stop pin 81 mounted by the magazine frame to back the two extreme positions between which the selector gates can oscillate. A torsion spring 84, coiled about shaft 76, has one end captured in collar 82 and the other end captured in crank arm 74. A sleeve 86, united with the crank arm, is formed with a notched 86*a* in which a pin 88 projecting radially from shaft 76 is received to impart only counterclockwise motion of the crank arm to the shaft. A notch 74*a* is also formed in the crank arm for receiving the tip of a pawl 90 which is pivotally mounted to the magazine frame by a pin 90*a*. The lower end of the pawl is pinned to the plunger 92*a* of a solenoid 92. While the catch lever is engaged in notch 74*a*, the crank arm of course can not oscillate, and shaft 76 remains stationary with selector gates 78 in the vertical positions seen in FIG. 2. The gate surfaces 78*a* are contoured to advantageously serve, with the gates in their upright positions, as turnaround guides to maintain the ammunition rounds in the carrier positions as they negotiate the turnaround path section. If sprocket 52 is being driven while crank arm 74 is captured by the pawl, the spring of connecting rod 72 compresses allowing the connecting rod to contract lengthwise in lost-motion fashion in response to orbital movement of drive pin 70**.

Figure 3:
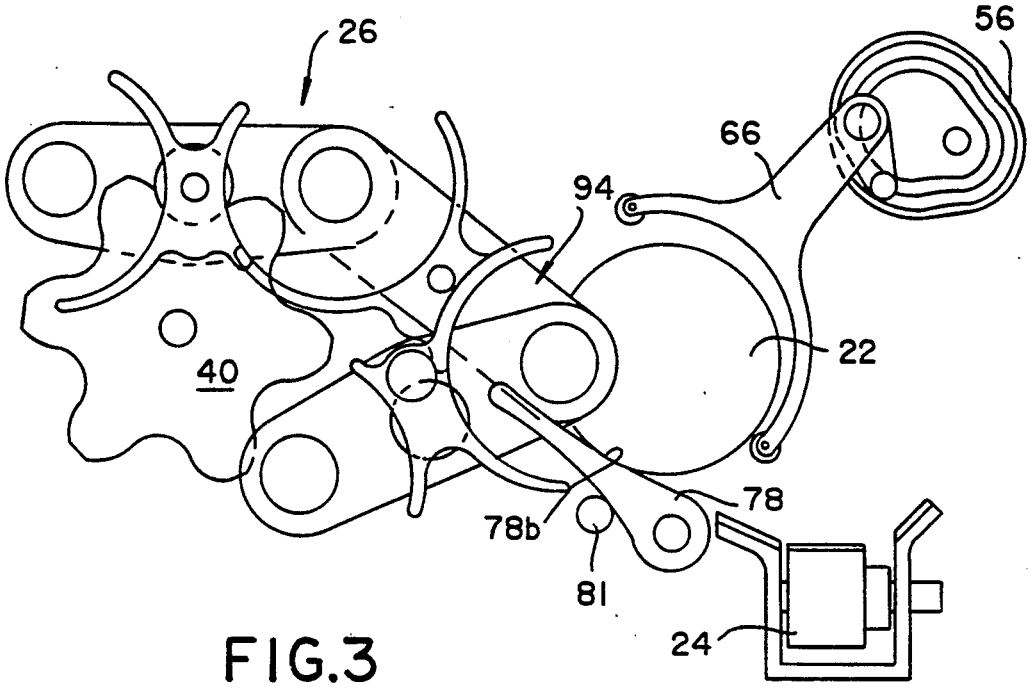
Figure 4:
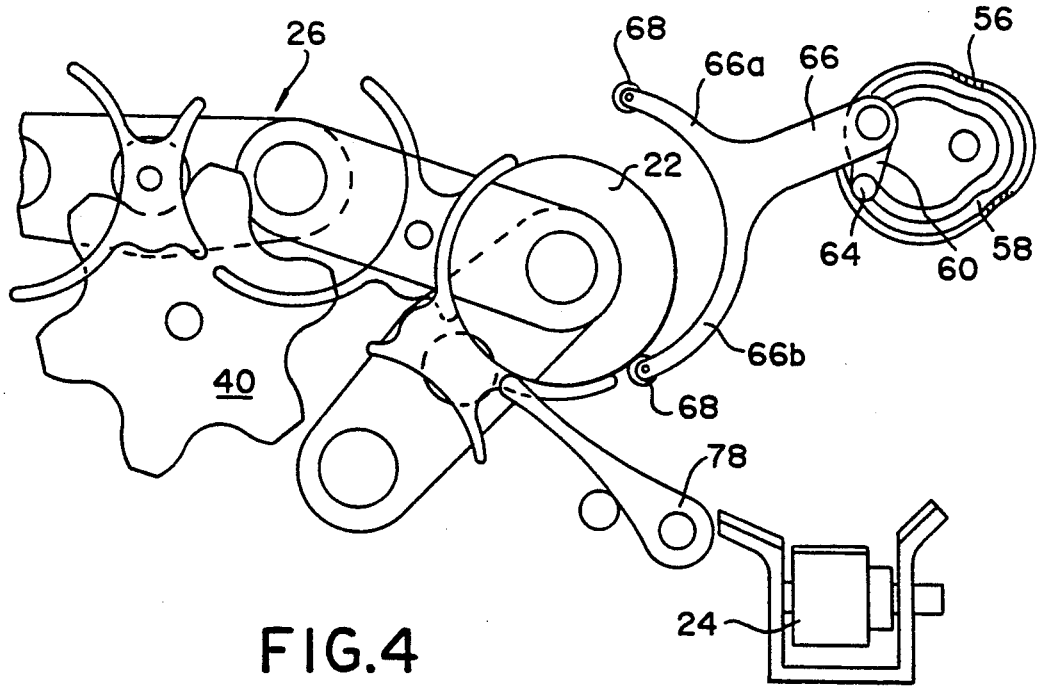

When the crank arm is released by solenoid 92, counterclockwise throws of the crank arm are communicated to shaft 76 via pin 88 catching in notch 86*a* to swing selector gates 78 into their inclined positions seen in FIGS. 3 and 4. Spring 84, which is preloaded to normally maintain pin 88 in notch 86*a*, serves to communicate clockwise throws of the crank arm to the selector gate shaft 76 in returning the gates to their upright positions. The utilization of this torsion spring in conjunction with the spring-loaded connecting rod relaxes the synchronization required between the magazine conveyor and the selector gate drive during downloading, since the selector gates can be effectively guided into a proper intercepting position by ammunition rounds moving through the turnaround path section, as will be more fully explained below.

To synchronize the magazine conveyor and transfer fork drives, the relative diameters of sprockets 44 and 50 are such that turnaround sprocket 40 makes two revolutions for every three revolutions of transfer fork cam 56. If it requires a one-third revolution of the turnaround sprocket to index the magazine conveyor one carrier position, the cam will then rotate one-half a revolution or 180° with each one-third revolution of the turnaround sprocket. As noted above, the camtrack 58 of cam 56 includes a 120° dwell section 58*a* and a 240° lobe section 58*b*. As will be seen, this configuration permits the transfer apparatus to upload ammunition rounds into every other carrier position as they swing counterclockwise or upwardly through the turnaround and to download ammunition rounds from every other carrier position as they swing clockwise or downwardly through the turnaround.

In FIG. 2, the transfer apparatus is illustrated in its initial upload position with transfer forks 66 depending generally downwardly and their tines 66*a* and 66*b* in cradling relation over the upper portion of an ammunition round presented in the upload position by conveyor 24. Selector gates 78 are spring-biased to their upright positions with stop projection 80*a* against stop pin 81 (FIG. 6). Also cam 56 is in the angular orientation shown with cam follower 64 at the end of dwell section 58*a* of the camtrack. When an empty carrier position, indicated at 94, starts its counterclockwise swing through the turnaround, drive sprocket 44 is engaged at the proper moment by clutch 46 (FIG. 5) to begin rotation of cam 56 in the counterclockwise direction. Cam follower 64 runs out of the dwell section into lobe section 58*b* to produce, via crank arm 60, clockwise rotation of shaft 62 and clockwise swinging motion of transfer forks 66. Fork tines 66*b* are elongated relative to tines 66*b*, such the their rollers swing into engagement with the ammunition round 22 at locations below the horizontal centerline thereof. The ammunition round is thus rolled laterally off the belt 24*a* of transfer conveyor 24 and out onto an inclined apron 25. With continued clockwise rotation of cam 56, cam follower 64 runs further into the lobe camtrack section 58*b*, causing the transfer forks to continue their clockwise swing. In the process, the rollers of tines 66*b* roll the ammunition off apron 25 toward the empty carrier position 98. FIG. 3 illustrates the empty carrier position approximately mid-way through the turnaround. Since the selector gates are merely spring biased to their clockwise-most upright position, they can be swung clockwise by the ammunition round as it is rolled out onto the apron without solenoid 92 having to release crank arm 74 (FIG. 6). As the ammunition round rolls off the conveyor apron, it progressively forces the selector gates to their counterclockwise most position with stop projection 80*b* against stop pin 81 to provide underlying support for the round as it rolls onto gate surfaces 78*b*.

FIG. 4 illustrates the completion of the upload lateral transfer, wherein the ammunition round has been rolled up the inclined surfaces 78*b* of the transfer gates by the transfer forks into the carrier position 94 with the round in full cradled engagement with associated retainer cradling elements 36*a*. Cam follower 64 is now approximate the peak of the lobe camtrack section 58*b* as carrier position 98 swings out of the turnaround with the ammunition round securely cradled therein. As cam 56 continues its clockwise rotation, the transfer forks are swing counterclockwise back to their upload position of FIG. 2 where it is held pending arrival of the next round on transfer conveyor 24 by cam follower 64 running in dwell camtrack section 58*a*. Concurrently, the selector gates are positioned back to their upright positions of FIG. 2 by their torsion spring. The selector gates and transfer forks are thus cleared from the path of the next carrier position which may contain an ammunition round as it swings through the turnaround. As noted above, surfaces 78*a* of the selector gates serve as turnaround guides for any ammunition round in this next carrier position. Cams follower 64 runs in the 120° dwell camtrack section 58*a* as cam 56 completes a full revolution and while the next carrier position swings through the turnaround.

As the cam starts into a second revolution, the transfer forks 66 and selector gates 78 are articulated to upload an ammunition round into the next carrier position as it swings through the turnaround. It is thus seen that the transfer apparatus 20 is capable of uploading ammunition rounds into every other carrier position on a continuous running basis. If the magazine conveyor 26 has an odd number of carrier positions, the magazine can be completely refilled with two full cycles of the magazine conveyor. However, if the magazine conveyor has an even number of carrier positions, a complete refill would require introducing a 120° phase shift between the magazine conveyor drive and the transfer apparatus drive via clutch 46 (FIG. 5).

To download the magazine, the magazine conveyor drive is reversed such that the carrier positions swing downwardly (clockwise) through the turnaround, rather than upwardly (counterclockwise) as during uploading. FIG. 4 illustrates the positions of the transfer forks 66 and selector gates 78 to begin the handoff of an ammunition round from a carrier position to the transfer apparatus. Downloading requires that solenoid 92 in FIG. 6 pull pawl 90 from notch 74*a* to release crank arm 74 so the selector gates can be positioned to their counterclockwise-most position of FIG. 4 by the selector gate drive, i.e., sprocket 52, eccentric pin 70 and connecting rod 72. Note that the tips of the selector gates then are in positions to intercept and divert an ammunition round out of cradled engagement with cradling element 36*a*. Once dislodged from its carrier position, the ammunition round rolls onto the inclined selector gate surfaces 78*b* to begin its rolling descent toward the linear transfer conveyor under the control of the transfer forks, specifically their tines 66*b*. FIG. 3 illustrates an intermediate stage in a download step. Note that stop 81 acting via stop projection 80*b* and bracket 80 (FIG.

6) backs the selector gates in their support of the ammunition round. Any lack of synchronism between the selector gate drive and the progress of the ammunition round during a downloading step is accommodated by extension or contraction of spring-loaded connecting rod 72. FIG. 2 illustrates completion of a downloading step with an ammunition round resting on linear transfer conveyor 24. Again, the transfer apparatus downloads alternate carrier positions on a continuous running basis, thus requiring complete two cycles of the magazine conveyor to empty the magazine. If the magazine conveyor has an even number of carrier positions, a 180° phase shift must be introduced to download the entire magazine. In the disclosed embodiment, this is achieved by shifting the angular relationship between the magazine conveyor (turnaround sprocket 40) and the transfer apparatus drive (drive sprocket 4) after the first cycle.

Figure 5:
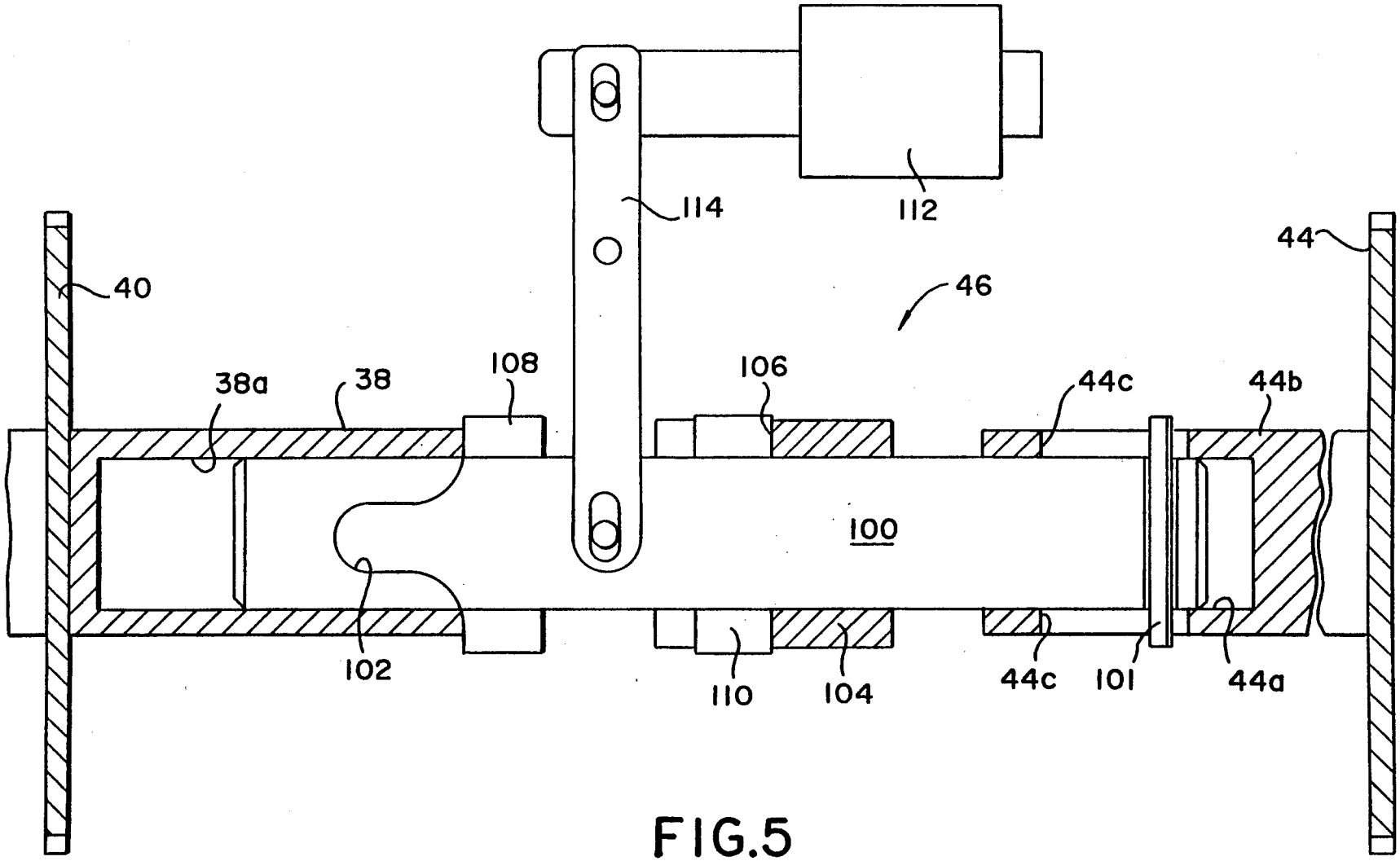
FIG. 5 is a simplified fragmentary side view of a positive clutch for selectively coupling the magazine conveyor drive to the transfer apparatus of FIG. 1.

As briefly described above, magazine conveyor drive is selectively coupled to the lateral transfer apparatus drive (sprocket 44) via clutch 46 seen in FIG. 5. This clutch includes an elongated cylindrical body 100 whose ends are dimensioned for close-fitting sliding receipt in an axial bore 38*a* in an end of turnaround sprocket shaft 38*b* and an axial bore 44*a* of transfer apparatus drive sprocket shaft 44*b*. Both of these shafts are journalled by the magazine frame in axially fixed positions by bearings (not shown). The right end of the clutch body received in bore 44*a* is drivingly connected to shaft 44*b* via a transverse drive pin 101 whose ends, projecting radially beyond the clutch body, are received in axially elongated slots 44*c* in shaft 44*b*. The end of turnaround sprocket shaft is formed with three recessed pockets 102 in 120° angularly spaced relation. A grounding collar 104 affixed to the magazine frame in surrounding relation with the clutch body is also formed with three recessed pockets 106 in 120° angularly spaced relation. The clutch body is formed with one set of three radially projecting dogs 108 in 120° angular spaced relation and a second set of dogs 110, also in 120° angularly spaced relation. A solenoid 112 is linked to the clutch body by a pivotally mounted lever 114 to axially shift the clutch body between an engaged position with dogs 108 lodged in shaft pockets 102 and a disengaged position with dogs 110 in collar pockets 106. In the engaged position, dogs 110 are cleared from pockets 106 to free the transfer apparatus drive sprocket 44 for driven rotation off the turnaround sprocket shaft 38 in synchronism with the magazine conveyor. In the disengaged position, dogs 108 are cleared from pockets 102, thus decoupling the turnaround sprocket shaft from drive sprocket 44, and, with dogs 110 lodged in pockets 106 of grounding collar 104, the transfer forks are held in their upload positions of FIG. 2. The 120° angular spacing between the dogs and pockets permits the introduction of the above-described 120° phase shift between the magazine conveyor and transfer apparatus drives necessary to completely fill and empty a magazine having an even number of conveyor carrier positions. The 120° phase shift may also be utilized to upload and download different types of ammunition into and out of selected carrier positions.

Figure 7:
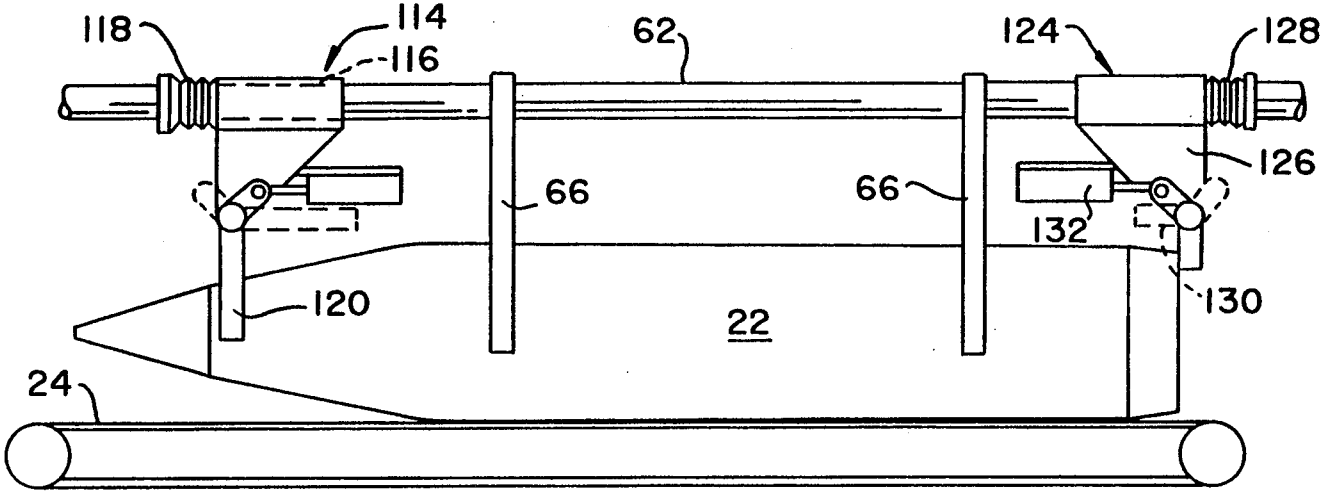
FIG. 7 is a simplified front view of linear conveyor stop/buffer mechanisms utilized in the transfer apparatus of FIG. 1.

To ensure that ammunition rounds are presented to the transfer apparatus in the requisite upload position on linear transfer conveyor 24, the transfer apparatus is further equipped with a pair of stop/buffer mechanisms seen in FIG. 7. One mechanism, generally indicated at 114, includes a bracket 116 splined on transfer fork shaft 62 to pivot with rotation of the shaft, but free to slide axially thereon. The bracket is biased to an appropriate axial position by a resilient buffer 118 fixed to the shaft. Pivotally mounted to the bracket is a depending nose stop fork 120 similarly shaped, but smaller than transfer forks 66, such that it engages the ogive of a projectile being conveyed from the right by conveyor 24 to stop it at the upload position. The impact is absorbed by buffer 118. Compression of the buffer can be sensed to stop conveyor 24, or the nose stop fork can simply stall the projectile in the upload position with the conveyor running until uploaded by the transfer apparatus. A actuator 122, mounted by bracket 116, pivots the nose stop fork to its phantom line position to clear the way for downloading projectiles and propellant canisters.

To align projectiles and propellant canisters in the upload position when conveyed thereto from the left, a second stop/buffer mechanism, generally indicated at 124, is utilized. A bracket 126 and buffer 128 are mounted to the transfer fork shaft 62 in the same manner as bracket 116 and buffer 118. A depending base stop 130 is pivotally mounted to bracket 128 in position to engage the base of a projectile or propellant canister and stop it in the appropriate upload position, with buffer 128 absorbing the impact. An actuator 132 pivots the base stop to its phantom line position to clear the way during downloading.

Alternatively, an ammunition round sensing device, such as a proximity sensor or probe, may be utilized with a servo-controller for the linear conveyor drive to stop linear conveyor 24 as each round arrives at the upload position transversely aligned with the magazine conveyor.

Figure 8:
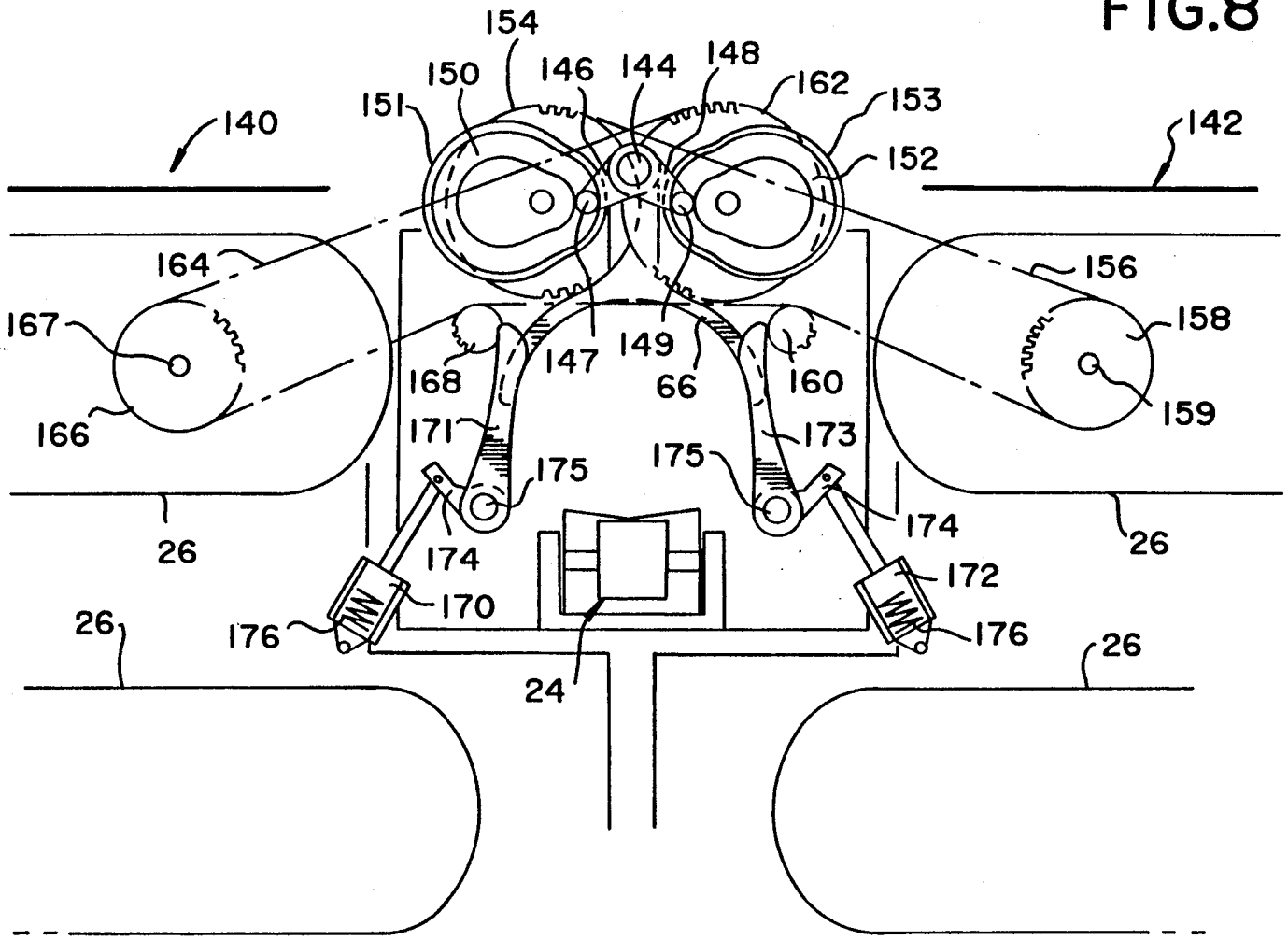
FIG. 8 is a side view of an alternative embodiment of the invention wherein the transfer apparatus uploads and downloads ammunition between a linear transfer conveyor and a pair of magazine conveyors.

FIG. 8 illustrates that the transfer apparatus of FIG. 1 can be expanded to upload and download a pair of magazines, generally indicated at 140 and 142, positioned in transversely aligned relation on opposite sides of linear transfer conveyor 24. Magazines 140 and 142 each include a magazine conveyor 26 identical to magazine conveyor 26 in FIG. 1. A shaft 144 mounts a set nf transfer forks 66 in positions above the upload position on conveyor 24.

Figure 9:
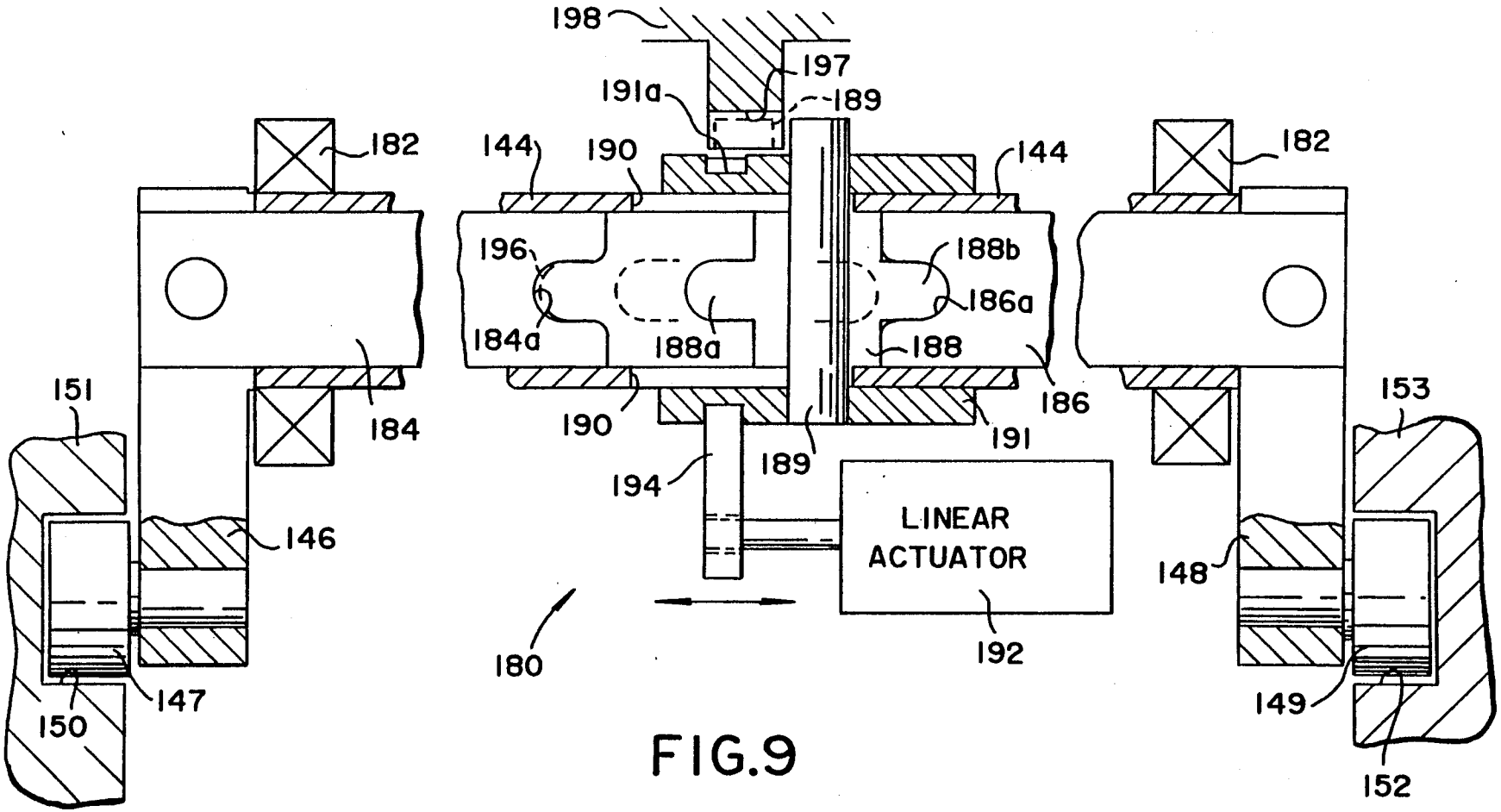
FIG. 9 is a simplified fragmentary side view, partially broken away, of a positive clutch for selectively coupling the magazine conveyor drives to the transfer forks in the embodiment of FIG. 8.

Separate crank arms 146 and 148 are pinned to shaft 144 adjacent opposite ends thereof, as seen in FIG. 9. Crank arm 146 carries a cam follower 147 which runs in the camtrack 150 of a cam 151, while crank arm 148 carries a cam follower 149 which runs in the camtrack 152 of cam 153. Cams 151 and 153 are each similar to cam 56 of FIG. 1. Cam 151 is affixed on the shaft of a sprocket 154 which is driven by a drive chain 156 engaged with a drive sprocket 158 affixed on the shaft 159 of the turnaround sprocket (not shown) for the magazine conveyor 26 of magazine 142 and an idler sprocket 160. At the other end of the transfer apparatus, cam 153 is affixed on the shaft of a sprocket 162 which is driven by a drive chain 164 engaged with a drive sprocket 166 affixed on the shaft 167 of the turnaround sprocket for magazine conveyor 26 of magazine 140 and an idler sprocket 168. The two magazine conveyors may be driven by a single motor or by separate motors, which would advantageously permit uploading or downloading of one magazine, while the conveyor of the other magazine is in a high-speed search mode pursuant to uploading or downloading particular types or ammunition rounds into or out of preselected carrier positions. Alternatively, magazines 140 and 142 may in fact, be a single magazine, with the transfer apparatus transferring ammunition rounds between the linear transfer conveyor and separate turnarounds of the same magazine conveyor. In contrast to the selector gate drive seen in FIGS. 1 and 6, the embodiment of FIG. 8 utilizes a solenoid 170 to articulate the set of selector gates 171 serving magazine 140 and a separate solenoid 172 to articulate the set of gates 173 serving magazine 142. The plungers of these solenoids are pinned to crank arms 174 fixed on the shafts 175 mounting the selector gates 171 and 173 so that either selector gate set can be swung to its round intercept position for separate downloading of the magazines upon energization of the appropriate solenoid. The magnetic compliance of the energized solenoid permits the selector gates to be guided to their intercept positions by the ammunition rounds swinging through the turnaround. Plunger return springs 176 allow the selector gates to be swung into their support positions by an ammunition round as it is being uploaded by the transfer forks. Bifurcated stop brackets and frame mounted stop pins, as shown in FIG. 6, are utilized to support the selector gates 171 and 173 in their extreme clockwise and counterclockwise positions. It is thus seen that cam 151 and selector gates 173 operate to upload and download a magazine 142, whereas cam 153 and selector gates 171 operate to upload and download magazine 140. In each case, the uploading and downloading operations are as described above for magazine 30 in conjunction with FIGS. 2–4.

Rather than using a pair of two-position clutches, such as clutch 46 (FIG. 5), to separately clutch in the lateral transfer apparatus from each of the two magazine conveyors, the embodiment of FIG. 8 employs a three-position clutch, generally indicated at 180 in FIG. 9. The transfer fork mounting shaft 144 is provided as a hollow shaft journalled for rotation at each end by bearings 182. Inserted in the left end of shaft 144 is a cam follower shaft 184 to which is pinned crank arm 146 for cam follower 147 running in camtrack 150 of cam 151. A second cam follower shaft 186 is inserted in the right end of transfer fork shaft 144, and pinned to it is crank arm 148 for cam follower 149 running in camtrack 152 of cam 153. Also received in the hollow transfer fork shift is a cylindrical clutch body 188 in position between the inner ends of cam follower shafts 184 and 186. The clutch body carries a transverse pin 189 which extends radially through axially elongated, diametrically opposed slots 190 in the transfer fork shaft into engagement with a collar 191 slidingly mounted on the shaft periphery. Thus, the clutch body, collar, and transfer fork shaft are interconnected by pin 189 to rotate as a unit. The clutch body also carries axially opposed dogs **188*a* and 188*b*, while the inner ends of cam follower shafts 184 and 186 are formed with recessed pockets 184*a* and 186*a*, respectively. A linear actuator 192 carries an arm 194 whose free end is slidingly received in a circumferential groove 191*a* formed in the outer surface of collar 191 to axially position the clutch body 188** to its three clutch positions.

In the rightmost position shown in solid line in FIG. 9, clutch body dog **188*b* is lodged in pocket 186*a* of shaft 186, and thus transfer fork shaft 144 is oscillated by the rotation of cam 153 to upload and download magazine 144 (FIG. 8). Dog 188*a* is clear of pocket 184*a* in shaft 184, and thus the transfer fork shaft is declutched from the rotating cam 151. When the linear actuator positions the clutch body to its leftmost position, dog 188*a* is lodged in pocket 184*a* of shaft 184, as indicated at 196, and the transfer fork shaft is clutched into the rotating cam 151 to upload and download magazine 142. In this clutch position, clutch dog 188*b* is cleared from shaft pocket 186*a* to declutch the transfer fork shaft from cam 153. To declutch the transfer fork shaft from both cams, the linear actuator slides the clutch body to a centered position where an exposed end of pin 189 is received in a notch 197 formed in grounding structure 198. The transfer fork shaft is then held in a fixed angular position with transfer forks 66 positioned over the liner transfer conveyor 24 as shown in FIG. 8**.

Figure 10:
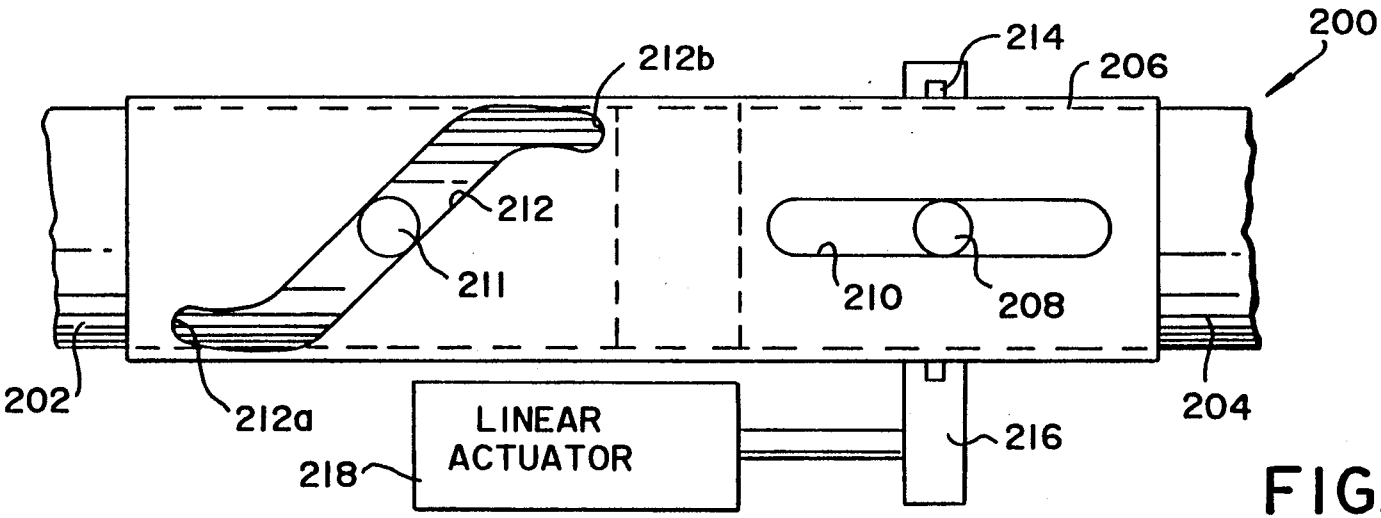
FIG. 10 is a simplified, fragmentary view of a phase shifter utilized in the embodiment of FIG. 8.

FIG. 10 discloses an exemplary 120° phase shifter 200 for installation between the turnaround sprocket shaft of each magazine conveyor and the transfer apparatus drive sprocket shaft to enable uploading and downloading magazine conveyors having an even number of carrier positions and to facilitate uploading and downloading of ammunition rounds to and from any selected carrier position. Thus, reference numeral 202 represents the turnaround sprocket shaft for conveyor 26 in either of magazines 140 or 142 in FIG. 8. Reference numeral 204 represents either of drive sprocket shafts 159 or 167 in FIG. 8. The confronting ends of the coaxially aligned shafts 202 and 204 are received in an elongated sleeve 206. Shaft 204 carries a traverse pin 208 which protrudes through an axially elongated slot 210 in the sleeve, while shaft 202 carries a transverse pin 211 which protrudes through an S-shaped slot 212 in the sleeve. The S-shaped slot is terminated in axially extending notches **212*a* and 212*b* in 120° angularly spaced relation. The sleeve is provided with a circumferential external rib 214 which is slidingly engaged by a collar 216 linked to a linear actuator 218. By virtue of this construction, it is seen that the linear actuator can shift sleeve 206 between extreme left and right axial position determined by the engagement of pin 208 against the terminations of slot 210 to more pin into either of the notches 212*a* or 212*b* in slot 212 and thus shift the angular relationship between shafts 202 and 204** by 120°

It is seen that the objectives set forth, including those made apparent from the Detailed Description, are efficiently attained, and, since certain changes may be made in the constructions set forth without departing from the scope of the invention, it is intended that matters of detail be taken as illustrative, and not in limiting sense.

Having described the invention, what is claimed as new and desired to secure by Letters Patent is:

1. Ammunition handling apparatus comprising, in combination:

A. an ammunition storage magazine;

B. a rotary conveyor contained by said magazine, said conveyor including 1) a series of carrier elements for retaining horizontally oriented rounds of ammunition in a succession of carrier positions during conveyance within said magazine, and 2) at least one turnaround path section;

C. a linear transfer conveyor for conveying ammunition rounds to and from said magazine along a horizontal path aligned with the ammunition round axis; and D. a transfer mechanism for laterally transferring ammunition rounds between said transfer conveyor and said rotary conveyor without axial reorientation of the ammunition rounds, said transfer mechanism including 1) at least one first transfer element driven in synchronism with said rotary conveyor and mounted for pivotal movement between a first position in engagement with an ammunition round on said transfer conveyor and a second position in ammunition round exchanging relation with a set of said carrier elements for one of said carrier positions on said rotary conveyor while moving through said turnaround path section, and 2) at least one second transfer element operating in conjunction with said first transfer element to provide underlying, rolling support for the ammunition rounds during lateral transfer.

2. The ammunition handling apparatus defined in claim 1, wherein said first transfer element is configured as a fork having a pair of tines, said fork is mounted for pivotal movement between said first and second positions, and when said fork is in said first position said tines are partially cradling the ammunition round on said linear conveyor for above.

3. The ammunition handling apparatus defined in claim 2, wherein said second transfer element is configured as a gate mounted for pivotal movement between an upright position and an inclined position, said gate providing, while moving between said upright and inclined positions, underlying, rolling support for an ammunition round during lateral transfer by said fork.

4. The ammunition handling apparatus defined in claim 3, wherein said gate includes a guide surface disposed, with said gate in said upright position, to serve as a turnaround guide for maintaining ammunition rounds in said carrier positions while moving through said turnaround path section.

5. The ammunition handling apparatus defined in claim 4, wherein said gate further includes a support surface and a free end portion, said free end portion disposed, with said gate in said inclined position, in intercepting relation with an ammunition round moving through said turnaround path section to direct the intercepted ammunition round out of its said carrier position onto said support surface and into cradling relation with said tines of said fork in said second position to download the ammunition round from said rotary conveyor.

6. The ammunition handling apparatus defined in claim 5, wherein said transfer mechanism further includes rigid stop means stationed to support said gate in said upright and inclined positions.

7. The ammunition handling apparatus defined in claim 6, wherein said tines of said fork have free ends mounting ammunition round engaging rollers.

8. The ammunition handling apparatus defined in claim 6, wherein said rotary conveyor is driven such that said carrier positions move upwardly through said turnaround path section to upload ammunition rounds into said magazine and move downwardly through said turnaround path section to download ammunition rounds from said magazine.

9. The ammunition handling apparatus defined in claim 8, wherein said transfer mechanism further includes a first shaft mounting at least two said forks and a second shaft mounting at least two said gates.

10. The ammunition handling apparatus defined in claim 6, wherein said transfer mechanism further includes resilient drive means for biasing said gate to said upright position and propelling said gate to said inclined position.

11. The ammunition handling apparatus defined in claim 8, wherein said transfer mechanism further includes a phase-shifting clutch for selectively drivingly connecting said transfer mechanism with said rotary

12. The ammunition handling apparatus defined in claim 1, wherein said transfer mechanism further includes means for stopping said ammunition rounds conveyed to said magazine by said transfer conveyor in a predetermined upload position.

13. The ammunition handling apparatus defined in claim 1, which further includes a motor for commonly driving said rotary and transfer conveyors and said transfer

14. The ammunition handling apparatus defined in claim 1, wherein said ammunition storage magazine comprises first and second storage magazines disposed in transversely aligned relation on opposite sides of said transfer conveyor, and said rotary conveyor comprises first and second rotary conveyors respectively contained in said first and second storage magazines, said apparatus further including 1) first and second sets of plural said second transfer elements, 2) a third set of plural said first transfer elements, and 3) clutch means for drivingly connecting said third set of said first transfer elements to said first rotary conveyor to laterally transfer ammunition rounds between said transfer conveyor and said first rotary conveyor with underlying support provided by said first set of said second transfer elements and for drivingly connecting said third set of said first transfer elements to said second rotary conveyor to laterally transfer ammunition rounds between said transfer conveyor and said second rotary conveyor with underlying support provided by said second set of said second transfer elements.

15. Ammunition handling apparatus comprising, in combination:

A. an ammunition storage magazine;

B. a rotary conveyor contained by said magazine, said rotary conveyor including 1) a series of carrier elements for retaining horizontally oriented rounds of ammunition in a succession of carrier positions during conveyance within said magazine, and 2) at least one turnaround section;

C. a linear transfer conveyor for conveying ammunition rounds to and from said magazine along a horizontal path aligned with the ammunition round axis; and D. a transfer mechanism for laterally transferring ammunition rounds between transfer and rotary conveyors without axial reorientation of the ammunition rounds, said transfer mechanism including 1) a set of first transfer elements mounted on a first shaft located parallel to and generally above said transfer conveyor, (2) a set of second transfer elements mounted on a second shaft located parallel to said first shaft and between said transfer conveyor and said turnaround path section of said rotary conveyor, (3) first means for pivoting said first transfer elements between a first position in engagement with an ammunition round on said transfer conveyor and a second position in ammunition round exchanging relation with said carrier elements of one of said rotary conveyor carrier positions swinging through said turnaround path section, and (4) second means acting on said second shaft to pivot said second transfer elements between a first position clear of said rotary conveyor and a second position to pick an ammunition round from one of said carrier positions swinging through said turnaround section and to provide underlying rolling support for ammunition rounds uploaded onto said rotary conveyor during pivotal movement of said first transfer elements from said first to said second positions and for ammunition rounds downloaded from said rotary conveyor during pivotal movement of said first transfer elements from said second to said first positions.

16. The ammunition handling apparatus defined in claim 15, wherein said first means includes a rotary cam selectively drivingly connected to said rotary conveyor and a cam follower eccentrically mounted by said first shaft.

17. The ammunition handling apparatus defined in claim 16, wherein said cam is configured to upload and download every other of said succession of carrier positions on said rotary conveyor, said first means further including phase shifter for introducing predetermined phase shift in an angular drive relationship between said cam and said rotary conveyor.

18. The ammunition handling apparatus defined in claim 16, wherein said ammunition storage magazine comprises first and second storage magazines disposed in transversely aligned relation on opposite sides of said transfer conveyor, and said rotary conveyor comprises first and second rotary conveyors respectively contained in said first and second storage magazines, said apparatus further including 1) first and second sets of plural said second transfer elements, 2) a third set of plural said first transfer elements, and 3) clutch means for drivingly connecting said third set of said first transfer elements to said first rotary conveyor to laterally transfer ammunition rounds between said transfer conveyor and said first rotary conveyor with underlying support provided by said first set of said second transfer elements and for drivingly connecting said third set of said first transfer elements to said second rotary conveyor to laterally transfer ammunition rounds between said transfer conveyor and said second rotary conveyor with underlying support provided by said second set of said second transfer elements.

* * * * *